United States Patent [19]

Ekstrand et al.

[11] Patent Number: 4,947,102

[45] Date of Patent: Aug. 7, 1990

[54] FEEDBACK LOOP GAIN COMPENSATION FOR A SWITCHED RESISTOR REGULATOR

[75] Inventors: John P. Ekstrand, Palo Alto; Kevin Holsinger, Menlo Park, both of Calif.

[73] Assignee: Spectra-Physics, Inc., San Jose, Calif.

[21] Appl. No.: 269,194

[22] Filed: Nov. 8, 1988

[51] Int. Cl.[5] ..... G05F 1/46

[52] U.S. Cl. ..... 323/293; 323/288; 323/354; 363/89

[58] Field of Search ..... 323/293, 281, 284, 285, 323/288, 352, 353, 354, 364, 369, 370; 363/84, 86, 89

[56] References Cited

U.S. PATENT DOCUMENTS

| | | | |
|---|---|---|---|
| 4,237,405 | 12/1980 | Kellis | 323/288 X |
| 4,668,906 | 5/1987 | Ekstrand | 323/354 X |
| 4,719,404 | 1/1988 | Ekstrand | 323/354 X |
| 4,814,966 | 3/1989 | Ekstrand | 323/354 X |

FOREIGN PATENT DOCUMENTS

| | | | |
|---|---|---|---|
| 0265255 | 6/1970 | U.S.S.R. | 323/288 |

*Primary Examiner*—William H. Beha, Jr.
*Assistant Examiner*—Kristine Peckman
*Attorney, Agent, or Firm*—Lyon & Lyon

[57] ABSTRACT

A switched resistor regulator is constructed whose duty cycle response is nonlinear with small changes in input control voltage. Specifically, the response of a pulse-width modulator is made to increase less than linearly with small changes in input control voltage. In a preferred embodiment, the pulse-width modulator is altered by comparing the input control voltage with a nonlinear reference signal, rather than the substantially linear reference signal which is used in prior art pulse-width modulators. Specifically, the nonlinear reference signal may be generated by a nonlinear reference voltage circuit, such as an RC charging circuit, or such as a D/A converter controlled by a clocked programmable microprocessor.

15 Claims, 2 Drawing Sheets

FEEDBACK LOOP GAIN COMPENSATION FOR A SWITCHED RESISTOR REGULATOR

BACKGROUND OF THE INVENTION

1. Field of the Invention

This invention relates to switched resistor regulators. More specifically, this invention relates to controlling switched resistor regulators so that control feedback loop gain does not vary excessively with changes in operating voltage.

2. Description of Related Art

A switched resistor regulator ("SRR") is a type of power supply regulator, characterized by switching a resistor into and out of electrical connection between a power source and a load. SRRs and their operation are fully disclosed in U.S. Pat. No. 4,668,906, issued May 26, 1987 in the name of inventor John P. Ekstrand, and assigned to the same assignee. Some applications and improvements with respect to SRRs are disclosed in U.S. Pat. No. 4,719,404, issued Jan. 12, 1988 in the name of inventor John P. Ekstrand, and assigned to the same assignee, and in co-pending applications titled "SWITCHED RESISTOR REGULATOR WITH DIODE SNUBBER FOR PARASITIC INDUCANCE IN SWITCHED RESISTOR", Ser. No. 102,982, filed Sept. 30, 1988 in the name of inventor John P. Ekstrand, and assigned to the same assignee, and titled "SHUNT SWITCHED RESISTOR REGULATOR WITH DIODE SNUBBER", Ser. No. 103,095, filed Sept. 30, 1988 in the name of inventor John P. Ekstrand, and assigned to the same assignee, all hereby incorporated by reference as if fully set forth herein.

Further information on switched resistor regulators and their use is found in a co-pending application titled "SWITCHED RESISTOR REGULATOR CONTROL WHEN TRANSFER FUNCTION INCLUDES DISCONTINUITY", Ser. No. 269,238, filed this same day in the name of inventor John P. Ekstrand, and assigned to the same assignee, hereby incorporated by reference as if fully set forth herein.

A typical SRR employs a pulse-width modulator ("PWM") to generate a pulse train, which is applied to the switch for switching the resistor into and out of electrical connection. A feedback loop is employed to assure that the pulse train generated by the PWM switches the resistor at a duty cycle which preserves the indicated operating voltage and/or current. A problem arises when it is desired to operate the SRR at operating conditions which are widely varying. Because the SRR has a nonlinear response to changes in control voltage, the gain from the control voltage to the output voltage and/or current may differ at different operating conditions. This difference can be substantial when the operating conditions are substantially different.

In such cases, the feedback control loop employed by the SRR for stabilizing the duty cycle of the resistor will be subject to a problem. While it is not difficult to adjust for operating parameters (e.g. speed of response and reduction of ripple) which are optimum at any fixed operating point, it is difficult to select operating parameters which will be optimum (or nearly so) at operating voltages which are widely varying, precisely because the gain of the feedback control loop differs at different operating voltages. This effect is well known in the art of feedback regulative control. Inability to select those operating parameters which are preferred can degrade the performance of systems whose power is being supplied by the SRR.

SUMMARY OF THE INVENTION

A switched resistor regulator is constructed with a pulse-width modulator whose duty cycle response is nonlinear with changes in operating voltage. Specifically, the response of the pulse-width modulator is made to increase nonlinearly with small changes in input control voltage, so as to compensate for the nonlinear nature of the switched resistor regulator. In a preferred embodiment, the pulse-width modulator is altered by comparing the input control voltage with a nonlinear reference signal, rather than the substantially linear reference signal which is used in prior art pulse-width modulators. Specifically, the nonlinear reference signal may be generated by a nonlinear reference voltage circuit, such as an RC charging circuit, or such as a D/A converter controlled by a clocked programmable microprocessor.

BRIEF DESCRIPTION OF THE DRAWINGS

FIG. 5 shows an alternative embodiment of the invention including a D/A converter.

DESCRIPTION OF THE PREFERRED EMBODIMENT

Figure 1:
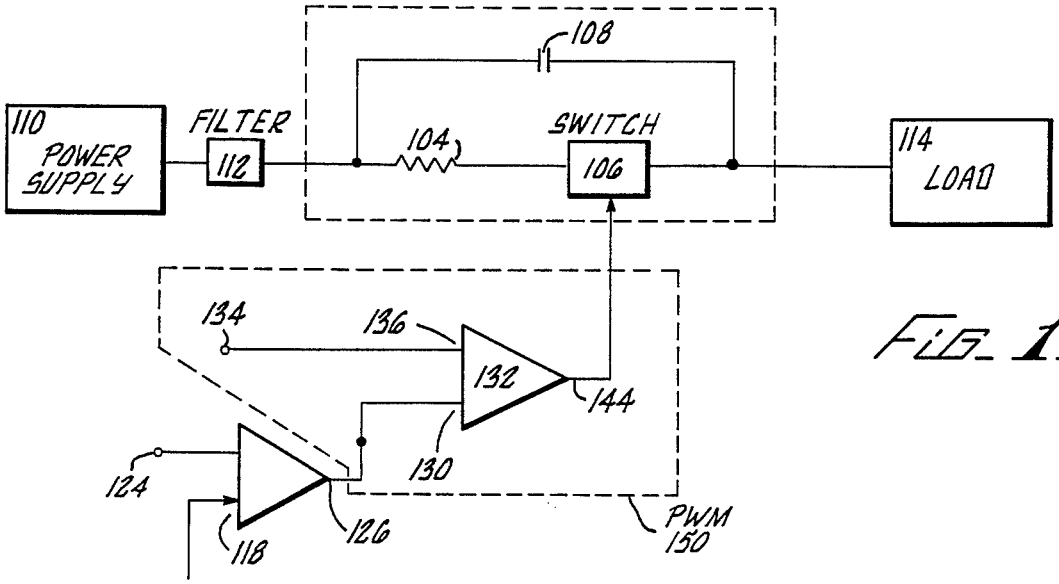
FIG. 1 shows a block diagram of a feedback loop employed for control of a switched resistor regulator.

FIG. 1 shows a block diagram of a switched resistor regulator ("SRR") and a feedback loop employed for control of that SRR. As is well known in the art, one configuration 102 of a SRR comprises a resistor 104, a switch 106, and a capacitor 108, and is electrically connected in series between an unregulated power supply 110 and filter 112, and a load 114. A voltage proportional to the current received by the load 114 appears at node 116, and is further transmitted to a first input 118 of a differential amplifier 120. A second input 122 of the differential amplifier 120 is set to a desired set point voltage at node 124. An output 126 of the differential amplifier 120 generates a control voltage, which is transmitted to an input 130 of a comparator 132. The comparator 132 compares this control voltage to a reference signal applied at node 134 and transmitted to another input 136 of the comparator 132, and generates an output pulse train at an output node 144, which is transmitted to and controls switch 106. When a configuration 102 of a SRR comprises more than one switch 106, output node 144 may comprise a plurality of nodes, e.g. nodes 144*a–b*, for control of a plurality of switches 106.

The PWM 150 may comprise the comparator 132, its output 144, and the control voltage 126 and reference signal applied to node 134. In a preferred embodiment, the PWM 150 may operate to generate a pulse train by comparing its input control voltage with a periodic reference voltage signal. The periodic reference signal is substantially linear in known PWMs used in the context of SRRs. In a preferred embodiment of the invention, the reference signal is nonlinear with such nonlinearity selected to compensate for the nonlinearity of the SRR. This is more fully disclosed with respect to FIG. 2.

Figure 2:
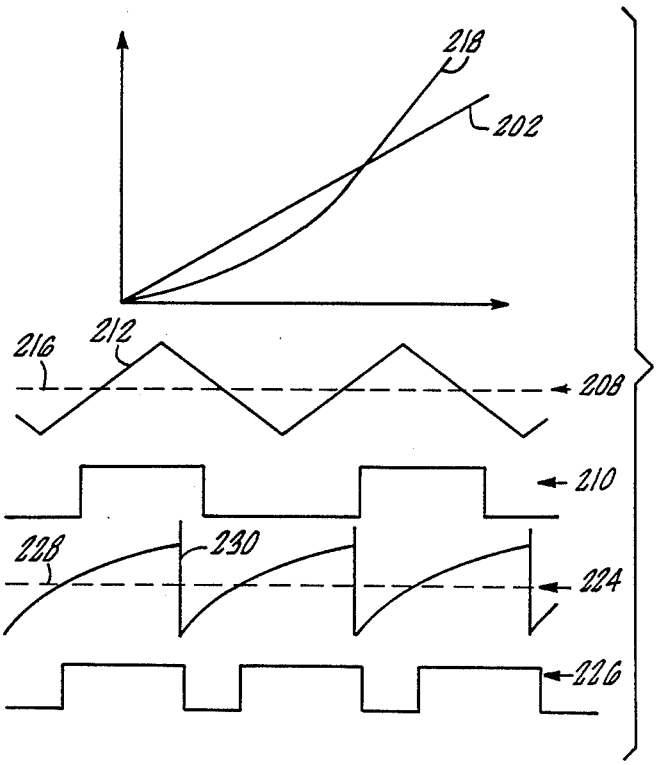
FIG. 2 shows several voltage response diagrams for switched resistor regulators.

FIG. 2 shows several response curves for PWMs of SRRs. Curve 202 shows the response of a PWM, in which pulse width is linear with control voltage. Curve 208 shows a reference signal 212 which is compared with a control voltage 216 so as to generate a train of pulses of varying width; curve 210 shows a resultant pulse train. Because the reference signal 212 rises and falls substantially linearly, the pulse width will change substantially linearly with control voltage 216, as shown in curve 202.

Curve 218 shows the response of a PWM in which the response has been altered to be nonlinear with control voltage. It will become clear to one of ordinary skill in the art that curve 218 may have other useful shapes in an embodiment of the invention, and that such would remain within the concept and scope of the invention. Curve 224 shows a control voltage 228 which is compared with a reference signal 230 so as to generate a train of pulses of varying width; curve 226 shows a resultant pulse train. Because the reference signal 230 rises and falls nonlinearly, a pulse generated in response to a control voltage 228 will vary in width substantially nonlinearly, as shown in curve 218.

Figure 3:
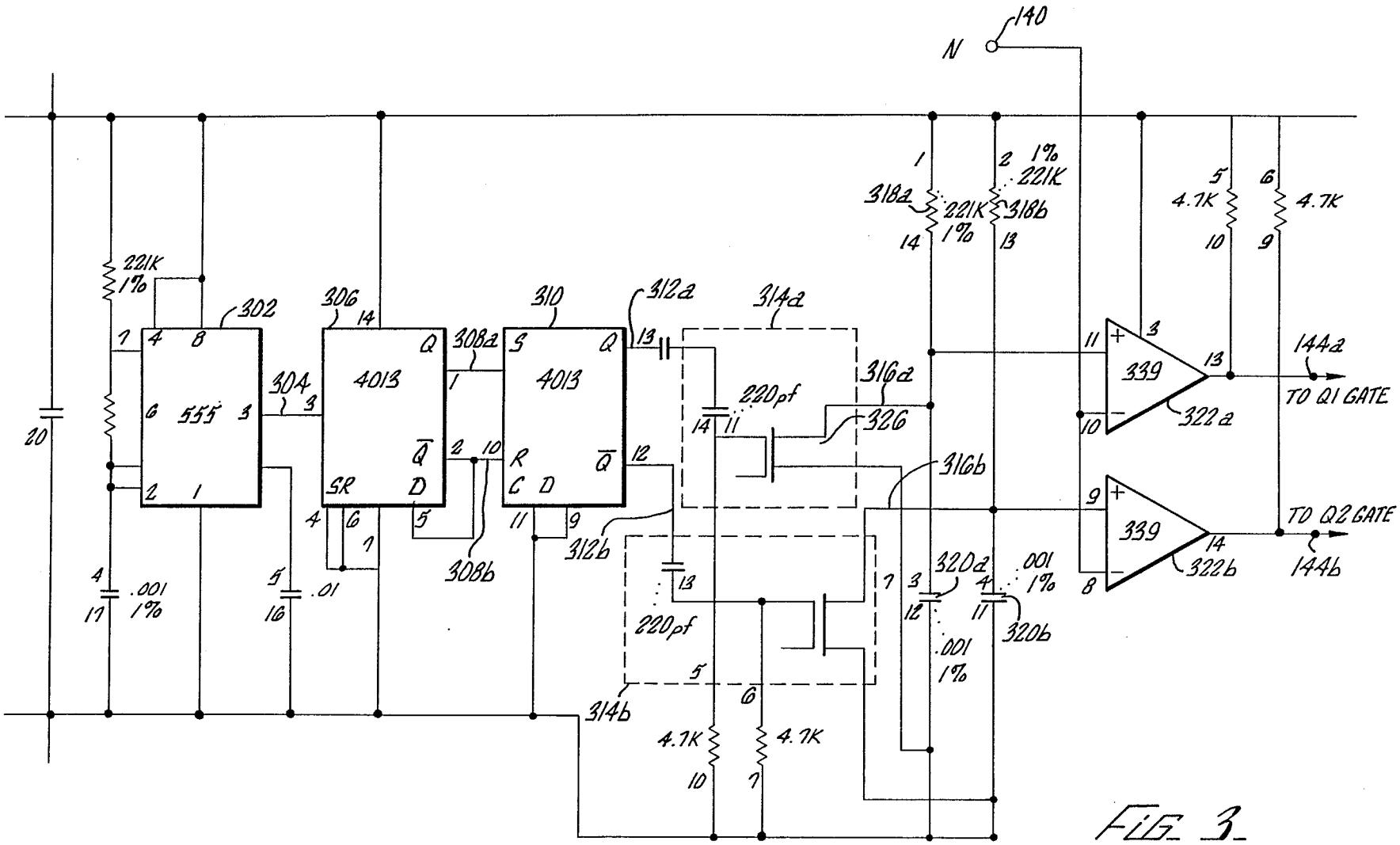
FIG. 3 shows a circuit diagram of a pulsed-width modulator for a switched resistor regulator.

FIG. 3 shows a circuit diagram of one configuration of a switched resistor regulator and control circuitry. A clock 302 generates a clock signal on path 304. The clock signal on path 304 is transmitted to a divide-by-two circuit 306, which generates a half-clock signal on a pair of paths 308*a–b*. The half-clock signal on paths 308*a–b* is transmitted to a buffer 310, which generates a pair of out-of-phase pulse signals on signal paths 312*a–b* respectively. The out-of-phase pulse signals on paths 312*a–b* are transmitted to a pair of reset-on-pulse circuits 314*a–b* respectively, each of which discharges a capacitor 320*a–b* respectively. The capacitors are recharged via timing resistors 318*a–b* respectively.

In a preferred embodiment, the control voltage is applied at an input 140, and compared by two comparators 322*a–b* to produce pulses at node 144*a–b*.

Figure 4:
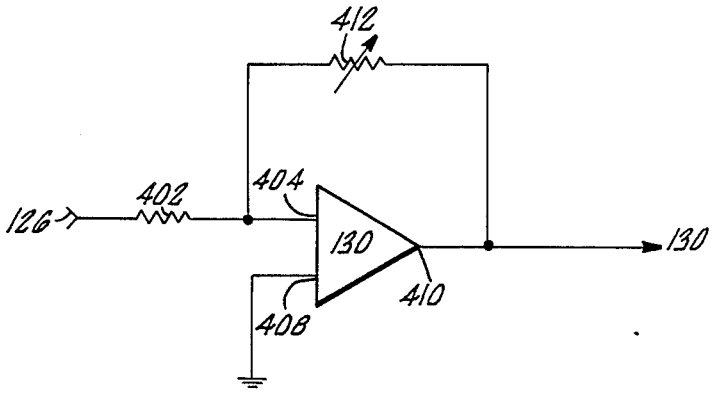
FIG. 4 shows a gain change element.

FIG. 4 shows a gain change element. In an alternate embodiment, a gain change element may be inserted in place of the wire 152 in FIG. 1. The control voltage from output 126 is passed through a resistor 402 and transmitted to a first input 404 of an operational amplifier 406. A second input 408 of the operational amplifier 406 is grounded. The first input 404 and an output 410 of the operational amplifier 406 are connected by a variable resistor 412. The output 410 is connected to input 130 of the comparator 132.

In a preferred embodiment, the variable resistor 412 may comprise any element which performs the function of a variable resistor. Examples include a potentiometer, a D/A converter, a FET, a light-sensitive cell or phototransistor, or any equivalent circuit.

FIG. 5 shows an alternative embodiment of the invention including D/A converter (154). All like circuit elements from FIG. 1 are represented by the same reference numerals.

While a preferred embodiment is disclosed herein, many variations are possible which remain within the scope of the invention, and these variations would become clear to one skilled in the art after a perusal of the specification, drawings and claims herein.

I claim:

1. A switched resistor regulator, comprising
resistive means;
switch means for switching said resistive means into and out of electrical connection;
means responsive to a signal for controlling the operation of said switch; and
means for altering said response to said signal to be nonlinear.

2. A switched resistor regulator as in claim 1,
wherein said signal comprises one of the group composed of: a digital signal, an analog signal.

3. A switched resistor regulator, comprising
resistive means;
switch means for switching said resistive means into and out of electrical connection;
means responsive to a control voltage for controlling the operation of said switch; and
means for altering said response to said control voltage to be nonlinear.

4. A switched resistor regulator, comprising
resistive means;
switch means for switching said resistive means into and out of electrical connection;
pulse-width modulator means responsive to a control voltage for generating a pulse train for controlling said switch means; and
means for altering the duty cycle of said pulse train to be nonlinear with changes in said control voltage.

5. A switched resistor regulator as in claim 4, comprising
means for altering said response so that said duty cycle of said pulse train varies at a nonlinearly increasing rate with increases in said control voltage.

6. A switched resistor regulator, comprising
resistive means;
switch means for switching said resistive means into and out of electrical connection;
means responsive to a signal for controlling the operation of said switch; and
means for altering said response to said signal so that a response of said switched resistor regulator is linear with changes in said control voltage.

7. A switched resistor regulator as in claim 6, wherein said signal comprises one of the group composed of: a digital signal, an analog signal.

8. A switched resistor regulator, comprising
resistive means;
switch means for switching said resistive means into and out of electrical connection;
means responsive to a control voltage for controlling the operation of said switch; and
means for altering said response to said control voltage so that a response of said switched resistor regulator is linear with changes in said control voltage.

9. In a switched resistor regulator, a pulse-width modulator, comprising
means for receiving a signal indicative of a duty cycle;
means responsive to said signal for generating a pulse train with a duty cycle, said duty cycle response being nonlinear with changes in said signal.

10. A pulse-width modulator as in claim 9, wherein said signal comprises one of the group composed of: a digital signal, an analog signal.

11. In a switched resistor regulator, a pulse-width modulator, comprising
means for generating a control voltage;
means responsive to said control voltage for generating a pulse train with a duty cycle, said duty cycle response being nonlinear with changes in said control voltage.

12. A pulse-width modulator as in claim 11, wherein said responsive means comprises means for receiving a predetermined nonlinear reference signal; and means for comparing said control voltage with said nonlinear reference signal.

13. A pulse-width modulator as in claim 11, comprising means for generating a predetermined nonlinear reference signal; and said responsive means comprises means for comparing said control voltage with said nonlinear reference signal.

14. A pulse-width modulator as in claim 13, wherein said means for generating comprises a resistor-capacitor circuit powered by a predetermined voltage.

15. In a switched resistor regulator, a pulse-width modulator, comprising means for receiving a control voltage;

means responsive to said control voltage for generating a pulse train with a duty cycle, said duty cycle response being nonlinear with changes in said control voltage;

said responsive means comprises means for generating a nonlinear reference signal, and means for comparing said control voltage with said nonlinear reference signal;

wherein said means for generating comprises a digital to analog converter.

* * * * *